US008402679B2

(12) United States Patent
Campbell

(10) Patent No.: US 8,402,679 B2
(45) **Date of Patent: *Mar. 26, 2013**

(54) REMOTE CONTROL SNOW REMOVER

(76) Inventor: Gregory Sylvester Campbell, Miramar, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/487,391

(22) Filed: Jun. 4, 2012

(65) Prior Publication Data

US 2012/0291317 A1 Nov. 22, 2012

Related U.S. Application Data

(63) Continuation-in-part of application No. 12/169,609, filed on Jul. 8, 2008, now abandoned.

(51) Int. Cl.
*E01H 5/09* (2006.01)

(52) U.S. Cl. ..... 37/246; 37/232; 37/260; 37/414; 37/442; 180/167; 701/2; 701/50

(58) Field of Classification Search ..... 37/246, 37/232, 233, 260, 266, 414, 442; 180/167–169; 701/2, 50

See application file for complete search history.

(56) References Cited

U.S. PATENT DOCUMENTS

| | | | | |
|---|---|---|---|---|
| 5,524,368 | A * | 6/1996 | Struck et al. | 37/235 |
| 6,035,478 | A * | 3/2000 | Miller et al. | 15/82 |
| 6,604,348 | B2 * | 8/2003 | Hunt | 56/10.6 |
| 6,691,435 | B1 * | 2/2004 | Schultz et al. | 37/234 |
| RE38,665 | E * | 12/2004 | Struck et al. | 37/235 |
| 7,318,493 | B2 * | 1/2008 | Medina | 180/167 |
| 2003/0104756 | A1 * | 6/2003 | Gordon | 446/154 |
| 2006/0162103 | A1 * | 7/2006 | Kallman et al. | 15/82 |
| 2007/0073465 | A1 * | 3/2007 | Brown et al. | 701/50 |
| 2007/0198159 | A1 * | 8/2007 | Durkos et al. | 701/50 |
| 2007/0294991 | A1 * | 12/2007 | Medina et al. | 56/11.9 |
| 2010/0094481 | A1 * | 4/2010 | Anderson | 701/1 |
| 2010/0094499 | A1 * | 4/2010 | Anderson | 701/23 |
| 2011/0295424 | A1 * | 12/2011 | Johnson et al. | 700/248 |
| 2011/0295636 | A1 * | 12/2011 | Anderson | 705/7.13 |

* cited by examiner

*Primary Examiner* — Matthew Buck

(57) ABSTRACT

A self propelled snow remover machine with a computer control panel a camera, a funnel design snow brush. The computer control panel controls the snow remover machine through a downloaded application with cloud technology and is access through many different electronic devices.

6 Claims, No Drawings

REMOTE CONTROL SNOW REMOVER

Continuation in part application number 12/169,609 filling date Jul. 8, 2008 now abandoned

BACKGROUND OF THE INVENTION

This invention relates to a working machine for remote control power brushing of snow and ice and is adapted for home and business use on driveways sidewalks roadways and elsewhere for power brushing and thus removing accumulations of ice and snow. More particularly the present invention provides a snow removal machine that is self propelled and remote control ideally suited for home and business use, because this invention is removing the operator from the weather element it is clean for the environment because of no chemical use and is readily available for the home and business use for the removal of snow and ice. Access is obtain through a mounted computer console with many different electronic devices by the user thereof. With cloud computing you have the application, platform, infrastructure, and servers to communicate with cell phones electronic tables, desktop computers, laptop computers. When the application is downloaded from the cloud, cloud-based technology will eliminate the need to send a signal or synchronize smartphones or other personal electronics with the mounted computer control console. It would draw all the information and media needed from the cloud application.

Cloud computing means: Access to and use of the resources.

The access to the cloud technology resource is:

Controlled by the entity, and restricted by them to their authorised users; delivered via the internet to all of these users.

The resources are:

Hosted by a service provider on behalf of the entity. Dedicated to their exclusive use, data processed by the resource is:

Private to the entity and its associates, entered or collected by them, or automatically produced for them.

The access to the cloud technology application gives the user of the remote control snow remover machine the ability to customize the features of the snow remover machine by choosing which features to download in the cloud application from your electronic device. The downloaded cloud application access is now possible many miles away. The remote control snow remover with a mounted camera is viewed in real time with 360 degrees movement as the remote control snow remover is in operation.

The invention claimed is:

1. A snow removal machine comprising of a carriage assembly an engine for driving, an electrical motor for supplying motive power to a circular funnel design snow brush, a battery to recharge and supply the electrical motor with power, ground engaging wheels beneath the carriage assembly a computer mounted control panel on the carriage assembly with cloud computing technology for automatic control of the snow removal machine by a user thereof.

2. A snow removal machine according to claim 1, in addition the computer mounted control panel is loaded with the cloud application that is accessible with an electronic device a desktop computer, laptop computer, a computer tablet or smart phone, or I phone, access is controlled by the cloud application and restricted to their authorised users, delivered via internet to all of these users, cloud based technology will eliminate the need to synchronize smartphones or other electronic devices with the computer mounted control panel it would draw all the information and media needed from the cloud application, with cloud based technology you have the option to choose certain features for the snow removal machine.

3. A snow removal machine according to claim 2, A camera is connected to the control panel for 360 degrees of movement cloud based technology gives the user real time video viewing while the snow removal machine is in operation.

4. A snow removal machine according to claim 2, A warning beeping sound is connected to the computer mounted control panel through the cloud application technology while the snow removal machine is in operation.

5. A snow removal machine according to claim 1, the snow brush is transversely mounted with extended arms on both sides of the brush with cables to transfer power from the electrical motor to the brush for progressive power brushing engagements with snow by a user thereof, the funnel design snow brush helps exit the snow left or right.

6. A snow removal machine according to claim 1, A plastic cover that encircles the snow removal machine and directs the snow removal machine to exit the snow left or right.

* * * * *